US005487606A

United States Patent [19]

Keller

[11] Patent Number: 5,487,606

[45] Date of Patent: Jan. 30, 1996

[54] MIXER FOR DOUBLE CARTRIDGE DISPENSER

[76] Inventor: Wilhelm A. Keller, Obstgartenweg 9, CH-6402 Merlischachen, Switzerland

[21] Appl. No.: 110,707

[22] Filed: Aug. 23, 1993

[30] Foreign Application Priority Data

Aug. 24, 1992 [EP] European Pat. Off. ..... 92810645

[51] Int. Cl.[6] ..... B01F 5/06; B67D 5/56

[52] U.S. Cl. ..... 366/339; 222/137; 222/145.6

[58] Field of Search ..... 366/177, 189, 366/336, 338, 339; 138/37, 39, 42; 222/135–137, 145

[56] References Cited

U.S. PATENT DOCUMENTS

| | | | |
|---|---|---|---|
| 2,816,518 | 12/1957 | Daggett | 222/145 |
| 3,570,719 | 3/1971 | Schiff . | |
| 4,538,920 | 9/1985 | Drake | 222/137 X |
| 4,652,175 | 3/1987 | Mauthe . | |
| 4,767,026 | 8/1988 | Keller et al. | 222/137 |
| 4,771,919 | 9/1988 | Ernst | 222/145 X |
| 4,846,373 | 7/1989 | Penn et al. | 222/137 |
| 4,869,400 | 9/1989 | Jacobs | 222/145 X |
| 4,989,758 | 2/1991 | Keller | 222/137 |
| 4,995,540 | 2/1991 | Colin et al. | 222/137 X |
| 5,033,650 | 7/1991 | Colin et al. | 222/137 |
| 5,080,262 | 1/1992 | Herold et al. | 222/137 X |
| 5,249,709 | 10/1993 | Duckworth et al. | 222/137 |

FOREIGN PATENT DOCUMENTS

| | | |
|---|---|---|
| 0232733 | 10/1989 | European Pat. Off. . |
| 0121342 | 10/1989 | European Pat. Off. . |
| 472448 | 2/1992 | European Pat. Off. . |

*Primary Examiner*—Charles E. Cooley
*Attorney, Agent, or Firm*—Marks & Murase

[57] ABSTRACT

A mixer for double dispensing cartridges having two storage cylinders whose volume ratio is different from 1:1 comprises a mixer housing which is attachable to the cartridges, and a mixing helix group which is arranged in the mixer housing. The two dispensing openings of the cartridges communicate with an inlet portion which precedes the mixing helix group and which is divided into a larger inlet chamber for the first component having a greater dispensing volume and a smaller inlet chamber for the second component having a smaller dispensing volume. The inlet portion is constructed to stem the first component and to supply the first component to the inlet chamber of the second component and to carry the latter along. Such a mixer allows an intimate mixing of the components without the need of uselessly dispensing a certain amount of the substance first in order to attain the correct mixing ratio.

19 Claims, 2 Drawing Sheets

MIXER FOR DOUBLE CARTRIDGE DISPENSER

BACKGROUND OF THE INVENTION

The present invention relates to a mixer for a double cartridge dispenser having at least two storage cylinders whose volumetric ratio is different from 1:1, comprising a mixer housing which is attachable to the cartridges and a mixing helix group which is arranged therein, the two dispensing openings of the cartridges communicating with the inlet portion of the mixing helix group. Such mixers are known, e.g., from EP-B-121,342, and they have the function of intimately mixing both components dispensed from the dispensing cartridges in order to prepare the components for their application.

In the case where both supply cylinders are approximately of the same volume and also comprise approximately equal dispensing openings, the mixing of the two components does not pose any problems from the outset. However, when the supply cylinders have essentially different volumes—which requires different cross-sectional areas because the supply cylinders have the same length on account of their manufacture and operation—and comprise outlet openings of, e.g., a ratio of 10:1, there is a risk that when the dispensing operation is started, the component from the larger supply cylinder fills the mixing helix group of the mixer due to different influences such as different elasticities of the two cartridge cylinders, so that the second component having a smaller volume is suppressed. Due to the fact that the second component is generally the hardener and that a mixture of components with an insufficient amount of hardener is useless, it is common practice, in order to stabilize the partial flows of the desired proportioning, to dispense a certain quantity which is discarded before being able to start the actual application of the mixture. Besides the loss of component substance, these dispensed substances cannot harden and may lead to disposal problems.

SUMMARY OF THE INVENTION

On this background, it is the object of the present invention to provide a mixer which ensures that the second component having a smaller volume is not suppressed, so that the uselessly dispensed substance is not produced in the first place or is very essentially reduced. This object is attained by a mixer having an inlet portion in front of the mixing helix group divided into a larger inlet chamber for the first component having a greater dispensing volume and a smaller inlet chamber for the second component having a smaller dispensing volume, and comprising first means for stemming the first component and second means for supplying the first component to the inlet chamber of the second component and for carrying the latter along.

Correspondingly, the inlet portion of the mixer is designed in such a manner that it is divided into a larger inlet chamber for the component having a greater dispensing volume and a smaller inlet chamber for the component having a smaller dispensing volume, and that the component in the larger inlet chamber is stemmed and subsequently supplied to the smaller inlet chamber in order to carry along the second component having a smaller volume.

It is thus ensured that both component flows are present from the beginning and that they can be mixed together in the following helix group. In a first embodiment of a mixing helix group having a smaller diameter, the first helix belongs to the inlet portion in which the first component is stemmed and supplied to the second component, and in a second embodiment of a larger mixing helix group, the first component is stemmed and supplied to the second component in the inlet chambers even before the first helix.

BRIEF DESCRIPTION OF THE DRAWINGS

The invention will be explained in more detail hereinafter with reference to drawings of preferred embodiments in which.

DETAILED DESCRIPTION OF THE INVENTION

Figure 1:
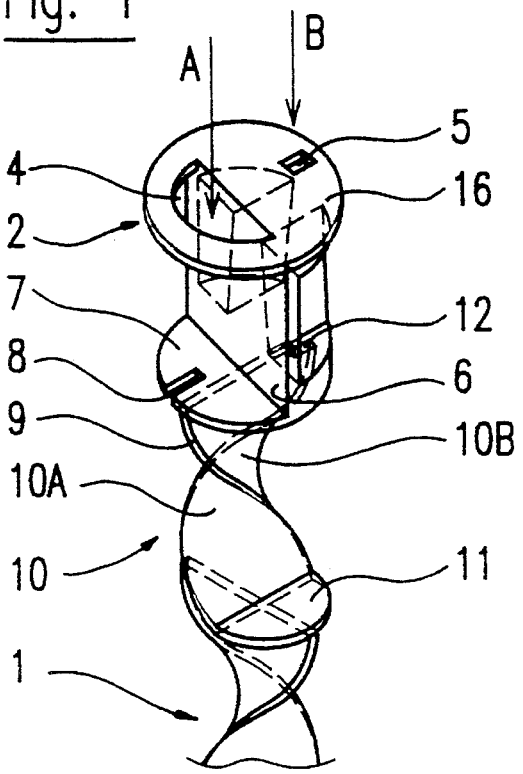
FIGS. 1 to 3 show a first embodiment of the invention in a perspective view.
Figure 2:
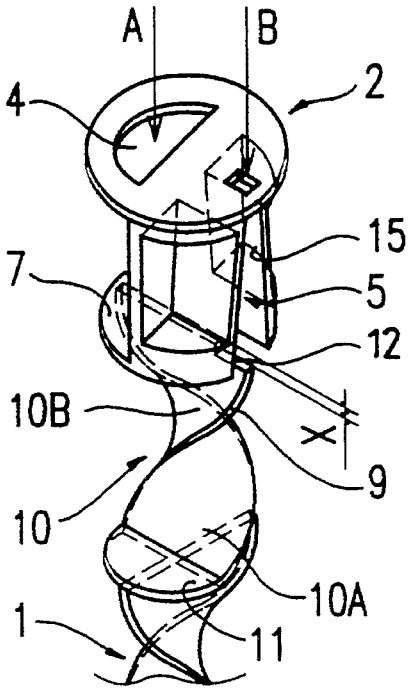
Figure 3:
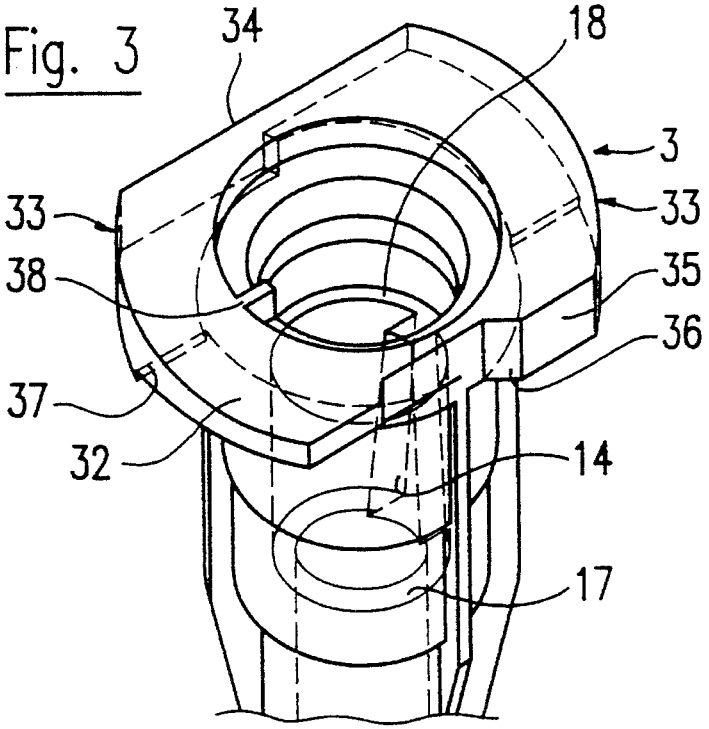

FIGS. 1 and 2 show an inlet portion 2 and the upper part of a mixing helix group 1 in two perspective views, and FIG. 3 shows the inlet of a mixer housing 3. In known mixers, one component is supplied to one half of the first helix and the other component to its other half, the mixing helix group being of such a construction that the two components mix well along the mixer until the dispensing end. As mentioned in the introduction, in known mixers having different volume ratios, i.e., cross-sectional ratios of the storage cylinders, it appears that the substance having a greater volume suppresses the substance having a smaller volume, particularly at the time when the mixing tube is filled, so that the prescribed mixing ratio is not obtained. After a certain time, i.e., when the mixer is completely filled and a certain amount has been dispensed, the mixing ratio of the partial flows stabilizes at a certain value.

In order to avoid that the component having a greater volume, in the present example substance A, which enters through the larger opening, advances in the mixer before component B with the smaller volume is allowed to mix therewith, it is suggested to stem component A at first and then to unite it with component B from the very beginning. In the first embodiment according to FIGS. 1–3 and 4, this is obtained by stemming component A in the inlet portion as well as in one half of the first helix, whereupon it is supplied to the other half thereof in order to carry along component B.

The inlet portion 2 leading to first helix 10, which belongs to the inlet portion, and to the mixing helix group 1, comprises a large inlet opening 4 for component A and a small inlet opening 5 for component B. The openings 4 and 5 lead to respective chambers that are separated by a wall 6. The chamber corresponding to the larger inlet 4 comprises a floor 7 in which an outlet opening 8 is arranged. As shown in FIG. 1, the outlet opening 8 is laterally displaced with respect to the wall 9 of the first helix 10 which is disposed in the center of the floor 7, so that the component A, which flows through the outlet opening 8, passes only to one side 10A of the helix 10. As further appears in FIG. 1, the wall 9 of the helix 10 extends perpendicularly to the separating wall 6 between the two inlet openings 4 and 5 and corresponding inlet chambers.

Without any further measures, component A would flow along mixing helix group 1 to the outlet opening and would eventually be mixed with component B. In order to prevent component A from flowing through in such a manner, a helix floor 11 is built in at the end of the first helix half 10A, the floor 11 sealing off the half 10A with only a minimal hairline crack for the evacuation of air being provided. Component A is thus stemmed by the floor 11 during the filling and fills the helix half 10A. In order to allow component A to continue its flow, a passage 12 having a height x for component B is provided in the helix half 10 B, the passage 12 being clearly visible in FIG. 2.

From the small inlet opening 5, i.e., the small inlet chamber, component B is directly supplied through helix half 10B into the following helixes 1 because the helix half 10B is not closed at the bottom. By this measure, i.e., by the retention of component A in the half 10A of the first helix 10 and by its passage to the other half, 10B the two components are already united in the second helix half 10B and mixed together in the following helixes 1, which is particularly important in the starting phase, i.e., before the entire mixer is filled up. The design of the following helixes of helix group 1 is the same as in previously known mixers and is therefore not further described.

Figure 4:
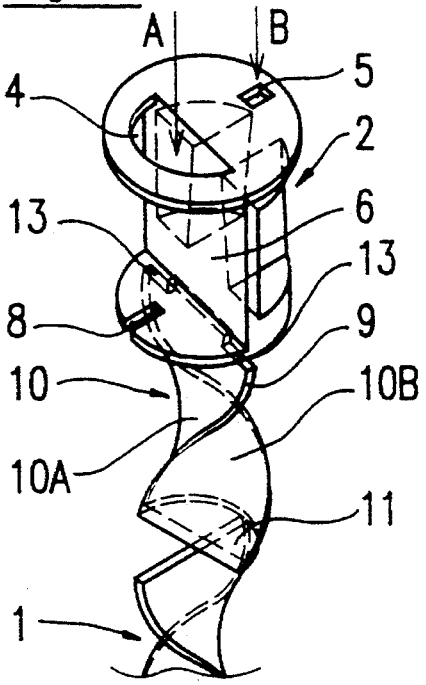
FIG. 4 shows an alternative of the first embodiment.

As indicated in an alternative embodiment according to FIG. 4, the helix wall 9 may also extend in parallel to the separating wall 6 and may be provided with two passages 13 instead of one such passage. Component B is thus surrounded by the two partial flows of component A through the two passages 13.

Basically, the small inlet opening 5, i.e. and the small inlet chamber might be injection-molded directly in the required dimensions, but this represents high demands of the injecting tools, particularly in the case of small helixes and small inlet openings, especially at a volume ratio of 10:1. It is therefore adequate to provide the small inlet opening and inlet chamber of the inlet portion with a relatively greater volume, which is easier to injection-mold, and to compensate it by means of a nose 14 in mixer housing 3 which projects into the smaller inlet opening and thereby determines (i.e., reduces) its cross-section. With respect to the manufacturing technique, it becomes thus possible to produce the same mixing helix group with the same inlet portion for a certain number of different inlet cross-sections, and to vary the dimensions of the nose 14 in the mixer housing. As shown in FIG. 2, the small inlet chamber does not have parallel longitudinal walls, but conically converging walls 15, whereby the insertion of nose 14 is facilitated. Neither the side walls nor the walls of the nose have to converge conically; both parts or one of them may be provided with parallel walls.

Nose 14 does not only serve the purpose of determining the cross-section of the smaller inlet opening, but also a second purpose, namely that of precisely positioning the mixing helix group with respect to the mixer housing when the mixer is assembled, since the two outlet openings of the cartridge have to coincide exactly with the inlet openings of the mixers when the mixer is attached to the dispensing cartridge. As appears in FIGS. 1 to 3, floor 7 and cover flange 16 comprising the two inlet openings 4 and 5 rest on the corresponding shoulders 17 and 18 of the mixer housing. Cover flange 16 then also forms a sealing surface for the cartridge outlet.

Figure 5:
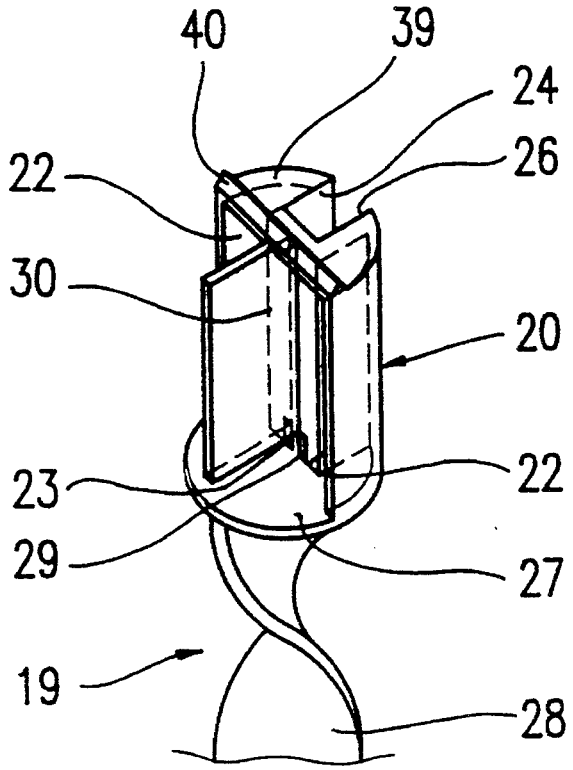
FIGS. 5 and 6 show a second embodiment of the invention.
Figure 6:
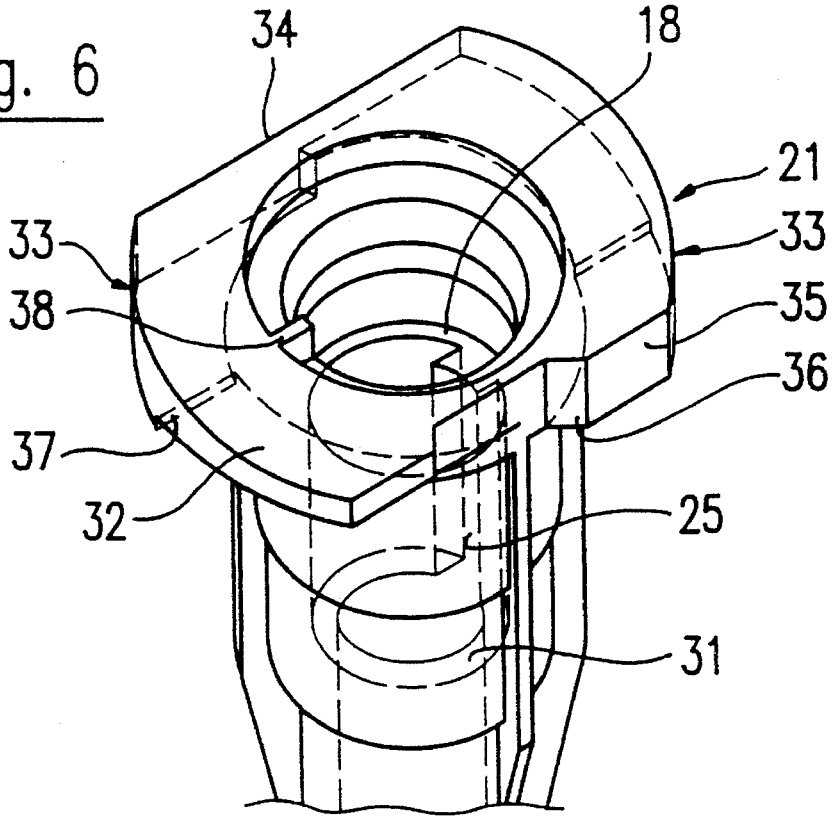

The second embodiment according to FIGS. 5 and 6 is particularly suitable for larger mixer diameters. In this case, component A is only stemmed in the two halves of the larger inlet chamber, so that the entire helix group can be used for mixing the two components. This also means that the inlet portion of this second embodiment is only formed by the inlet chambers, i.e., without a first helix. In FIG. 5, the inlet portion 20 and the upper part of the following mixing helix group 19 are shown, while FIG. 6 represents the inlet of the mixer housing 21. In this embodiment, the retention capacity ratio of the inlet chambers is greater than the respective mixing ratio. That part of the larger inlet chamber which is on the side of the small inlet chamber B is provided with a cover flange 39. The separation of the partial flows with respect to the outlet of the cartridge by a web 40 is effected in analogy to the previously known construction according to EP-B-232,733.

Larger inlet chamber 22 for component A is here divided for reasons of stability by a separating wall 23 which however need not be continuous. Smaller inlet chamber 24 for component B is only formed by a single chamber in this case. As in the first embodiment, the volume of the small inlet chamber 24, i.e., the surface of the small inlet opening, is determined, inter alia, by the dimension of the nose 25 of the mixer housing 21. In this embodiment, side walls 26 of the smaller inlet 24 chamber are disposed in parallel to each other.

The floor 27 of both halves of the larger inlet chamber 22 does not have an opening towards the bottom, i.e., towards the first helix 28. Component A is supplied to the smaller inlet chamber 24 by a respective throttle opening 29 in the wall 30 between the two inlet chambers 22 and 24 in order to be united with component B already there and to carry it along. Between the smaller inlet chamber 24 and the first helix 28, there is a direct passage, in such a manner that the two components may flow into the first helix 28. Throttle opening 29 has a similar function as passage 12 in the first embodiment and results in a stemming of component A when the mixer is filled up and a union with second component B at the very beginning of the mixer. In the present embodiment, the floor 27 rests on a corresponding shoulder 31 of the mixer housing.

It is also possible to combine the two embodiments, e.g., to assemble the inlet portion 20 of the second example with the first helix 10 of the first example.

In order to ensure that the dispensing openings of the double cartridge dispenser coincide with the inlet openings of the mixer, it is necessary to take measures providing that the mixer is attached to the cartridge dispenser in the right position, particularly when the volumetric and opening ratios of the two storage cylinders are different from 1:1. In general, in such cases a flange is provided on the mixer which is held in a corresponding holder at the dispensing end of the dispenser.

One such measure, for example, would be to arrange the flange eccentrically with respect to the center line, so that it fits into the corresponding holder in only one predetermined position. Another, simpler measure is suggested in FIGS. 3 and 6. Flange 32 is provided with two rounded sides 33 and with two straight sides 34 and 35, one side, namely side 35 in the example according to FIGS. 3 and 6, having a recess 36. One of the two retaining portions of the holder of the dispenser for a mixer comprising a flange, which is known per se, is provided with a corresponding key, so that the mixer can only be inserted in the holder in a predetermined position and is locked by a quarter turn. Two shoulders 37 on the mixing tube side of the mixer, which rest against the holder, serve for this purpose. In addition, the flange has a variable thickness in order to produce a contact pressure against the front side of the dispenser outlet nozzle.

In order to exclude in practice that the mixer is attached to the double cartridge dispenser in the wrong position, its opening is provided with a security cam 38 which matches a recess of a circular shoulder of the dispenser in the correct position of the mixer. It is understood that the key of the holder of the dispenser, the recess 36 of the flange of the mixer housing, the recess of the shoulder of the dispenser and the security cam 38 are disposed in a determined geometrical relation to each other, respectively, and to the two inlet chambers.

I claim:

1. A mixer for a double cartridge dispenser, comprising:

a mixer housing which is attachable to said dispenser; and a mixing helix group which is arranged in said mixer housing, said mixing helix group having an inlet portion for communicating with two dispensing openings of said dispenser;

said inlet portion being divided into a larger inlet chamber for receiving a first component having a greater dispensing volume from a first cylinder of the dispenser and a smaller inlet chamber for receiving a second component having a smaller dispensing volume than said first component from a second cylinder of the dispenser, said larger inlet chamber being larger than said smaller inlet chamber, and said mixing helix group comprising a first means for stemming a flow of said first component through said mixing helix group and a second means for supplying a stemmed flow of said first component to said smaller inlet chamber for carrying the second component along with the first component through the mixing helix group.

2. The mixer of claim 1, wherein said larger inlet chamber comprises a first helix and a first floor having an outlet opening leading to a first half of said first helix, said first half of said first helix being closed off by said first means for stemming, said first means for stemming being in the form of a second floor positioned at an end of the first half of the first helix opposite said first floor, and wherein a first wall between said first half and a second half of said first helix is provided with said second means for supplying in the form of a passage near said first floor, whereby said first component first fills up said first half of said first helix and is supplied through said passage to said second half of said first helix, where said first component unites with said second component and carries said second component along.

3. The mixer of claim 2, wherein a portion of said first wall between said first and second halves of said first helix is adjacent to said first floor of said larger inlet chamber add is arranged perpendicularly to a second wall between said two inlet chambers.

4. The mixer of claim 2, wherein a portion of said first wall between said first and second halves of said first helix is adjacent to said floor of said larger inlet chamber and is arranged in parallel to a second wall between said two inlet chambers, said passage comprising two passages extending through said first wall.

5. The mixer of claim 1, wherein said mixing helix group comprises a first helix downstream of said larger inlet chamber, said larger inlet chamber being completely closed off from said first helix by said first means for stemming, said first means for stemmin being in the form of a floor positioned between said larger inlet chamber and said first helix, and said second means for supplying comprises a throttle opening in a wall between said smaller inlet chamber and said larger inlet chamber, whereby said first component first fills up said larger inlet chamber and then is supplied through said throttle opening to said smaller inlet chamber where said first component unites with said second component and carries said second component along.

6. The mixer of claim 1, wherein said inlet chambers are at least partially closed by a cover flange having inlet openings.

7. The mixer of claim 1, wherein said mixer housing comprises a nose which projects into said smaller inlet chamber and determines a size of an opening of said inlet portion.

8. The mixer of claim 7, wherein side walls of said smaller inlet chamber and corresponding side walls of said nose converge conically.

9. The mixer of claim 7, wherein side walls of said smaller inlet chamber and side walls of said nose extend in parallel to each other.

10. The mixer of claim 1, wherein said mixer housing comprises a connecting flange for attachment to the dispenser, said flange being provided on one side with a recess for an aligned attachment thereof to said dispenser.

11. The mixer of claim 10, wherein said connecting flange comprises in addition to said recess a security cam for engaging a recess of said dispenser in order to allow an insertion of said flange into said dispenser in only one position.

12. A double cartridge dispenser, comprising:

a mixer housing having means for attaching to a dispensing cartridge holder;

a mixing helix group arranged in said mixer housing, said mixing helix group having an inlet portion for communicating with a pair of dispensing openings of a dispensing cartridge holder;

said inlet portion being divided into a first inlet chamber for a first component and a second inlet chamber for a second component, said first and second inlet chambers communicating with the pair of dispensing openings for receiving said first and second components from first and second cylinders of the dispenser, respectively, said first component having a larger dispensing volume than said second component, and said first inlet chamber being larger than said second inlet chamber;

said mixing helix group comprising a first means for stemming a flow of said first component through said mixing helix group and a second means for supplying said first component to said second inlet chamber after the flow of said first component is stemmed by said stemming means for carrying the second component along with the first component through the mixing helix group.

13. The dispenser according to claim 12, wherein said means for attaching comprises a connecting flange, said connecting flange being provided on one side with a recess.

14. The dispenser according to claim 13, wherein said recess provides means for ensuring aligned attachment of said mixer housing to a dispensing cartridge holder.

15. The dispenser according to claim 14, wherein said connecting flange comprises in addition to said recess a security cam for engaging a recess formed in a dispensing cartridge holder for allowing insertion of said connecting flange into the dispensing cartridge holder in only one position.

16. A mixer for a double cartridge dispenser, comprising:

a mixer housing; and a mixing helix group arranged in said mixer housing, said mixing helix group having an inlet portion and a helix portion, said inlet portion being divided into a first inlet chamber having a first inlet opening for receiving a first component from a first cylinder of the dispenser and a second inlet chamber having a second inlet opening for receiving a second component from a second cylinder of the dispenser, said first inlet chamber being adjacent and nonconcentric to said second inlet chamber;

said mixing helix group having a first means for stemming a flow of said first component through said mixing helix group and a second means for uniting said first component with said second component after the flow of said first component is stemmed by said stemming means for carrying the second component along with the first component through the helix portion of the mixing helix group.

17. The mixer of claim 16, wherein said first means for stemming comprises a first half of a first helix which forms part of said first inlet chamber, said first half of said first helix being closed off from said helix portion of said mixing helix group by a floor.

18. The mixer of claim 17, wherein said second means for uniting comprises a passage extending between said first half of said first helix and a second half of said first helix which forms part of said second inlet chamber, whereby said first component first fills up said first half of said first helix and is supplied through said passage to said second half of said first helix where said first component unites with said second component and carries said second component along.

19. The mixer of claim 16, wherein said first means for stemming comprises a floor that completely closes off said first inlet chamber from said helix portion of said mixing helix group, and said second means for uniting comprises a throttle opening in a wall between said first inlet chamber and said second inlet chamber, whereby said first component first fills up said first inlet chamber and then is supplied through said throttle opening to said second inlet chamber where said first component unites with said second component and carries said second component along.

* * * * *